United States Patent [19]

Kontz

[11] Patent Number: 4,754,962

[45] Date of Patent: Jul. 5, 1988

[54] APPARATUS FOR HANDLING AND STACKING THIN FLEXIBLE OBJECTS

[75] Inventor: Robert F. Kontz, Toledo, Ohio

[73] Assignee: Owens-Illinois Plastic Products Inc., Toledo, Ohio

[21] Appl. No.: 926,747

[22] Filed: Nov. 4, 1986

[51] Int. Cl.[4] ..... B65H 31/06; B65H 29/54

[52] U.S. Cl. ..... 271/307; 271/181; 271/196; 271/215; 271/220; 83/92; 83/96; 83/152

[58] Field of Search ..... 271/177, 180, 181, 186, 271/194, 195, 196, 213, 214, 215, 216, 220, 307, 309, 314, 900, 308; 83/94, 96, 135, 152, 154, 92, 92.1, 116, 117

[56] References Cited

U.S. PATENT DOCUMENTS

| | | | |
|---|---|---|---|
| 2,842,362 | 7/1958 | Hayes et al. | 271/900 X |
| 3,076,649 | 2/1963 | Stevenson | 271/307 |
| 3,148,879 | 9/1964 | Kistner | 271/181 X |
| 3,446,103 | 5/1969 | Foster | 271/186 X |
| 3,517,924 | 6/1970 | Digilio et al. | 271/177 |
| 3,545,746 | 12/1970 | Ledger et al. | 271/196 |
| 3,675,522 | 7/1972 | Hull | 271/196 X |
| 3,716,227 | 2/1973 | Bottcher | 271/180 |
| 4,056,264 | 11/1977 | Dhooge et al. | 271/177 |
| 4,073,487 | 2/1978 | Schirrmeister et al. | 271/196 X |
| 4,261,559 | 4/1981 | Mitzel | 271/196 |
| 4,310,152 | 1/1982 | Mitzel | 271/186 |
| 4,437,659 | 3/1984 | Caron et al. | 271/196 X |
| 4,440,388 | 4/1984 | Divoux et al. | 271/186 X |
| 4,466,605 | 8/1984 | Leuthold et al. | 271/196 X |
| 4,474,366 | 10/1984 | Reider | 271/181 |

FOREIGN PATENT DOCUMENTS

| | | | |
|---|---|---|---|
| 629435 | 5/1936 | Fed. Rep. of Germany | 271/194 |
| 1047055 | 11/1966 | United Kingdom | 271/181 |

*Primary Examiner*—F. J. Bartuska
*Assistant Examiner*—Edward S. Ammeen

[57] ABSTRACT

Apparatus for handling and stacking thin flexible objects or strips, which is particularly useful for labels and may also be used for tickets, cards, etc. In the preferred embodiment shown a supply of the strips is provided by withdrawing an elongated sheet from roll stock and cutting it into strips by coacting knife drum and strip support drum apparatus. A vacuum drum picks up the strips from the strip support drum and transfers the strips to a stacking apparatus. The transfer drum has grooves formed in its periphery to receive stripping fingers extending from the stacking apparatus. The stripping fingers divert the strips from the transfer drum to a stacking position at the stacking apparatus. A magazine and strip pusher are disposed on the opposite sides of the stacking position. Side and bottom wall extensions of the magazine define the stacking position and support the strip therein. The strip pusher includes a frame positioned across from the magazine opening. The frame is pivotally supported for reciprocal motion toward and away from the magazine opening in response to rotation of the transfer drum, thereby timing the reciprocation of operation only when a strip has been delivered to the stacking position.

9 Claims, 2 Drawing Sheets

APPARATUS FOR HANDLING AND STACKING THIN FLEXIBLE OBJECTS

BACKGROUND OF THE INVENTION

1. Field of the Invention

This invention relates generally to apparatus for handling and stacking thin flexible objects or strips, and is particularly useful with labels, tickets, cards, and the like.

2. Description of the Prior Art

There is a continuing need for improvements in methods and apparatus for handling and stacking thin flexible objects such as labels. The speed of printing machines, as both mechanisms and inks are improved, continue to increase. So, machines for handling and stacking such strips must also operate at high speeds to push articles onto a stack and operate reliably to prevent back up and interference with the continuous operation desired.

Simplicity in the use of components is therefore highly desirable. Some previous machines, such as that disclosed in U.S. Pat. No. 4,474,366, utilize a larger number of mechanical elements such as dogs or pusher feet which are satisfactory at slower speeds, but have more maintenance or shut-down problems because of the larger number of elements subject to wear and failure.

Other prior art disclosures in U.S. Pat. Nos. 4,440,388; 4,310,152 and 4,261,559 rely on internal switching of vacuum connections to drum surfaces that varies the vacuum force and/or provides compressed air to the drum surface. Again, these are complicated and expensive mechanisms that do not do as well in the long term as the apparatus described herein.

Finally, if the strips are labels, then the stack of labels should not include bent, buckled or otherwise deformed labels because the stack is to be used in direct feed operations in label application to containers. If the stack does contain such deformed labels then the label application machinery may jam, shutting down the operation of not only the application station but also the entire bottling or container filling line.

While the present invention is useful for handling labels made from all materials, it is particularly useful with labels made from thermoplastic materials such as expanded oriented polystyrene or cellular polymeric materials. Labels made from such materials sometimes tend to warp or cup making them more difficult to handle in general and particularly difficult to stack with existing apparatus.

SUMMARY OF THE INVENTION

An improved apparatus for handling and stacking thin flexible objects such as label strips is disclosed which includes means for successively supplying the strips, means for stacking the strips, means for transferring the strips from the successive supplying means to the stacking means. The transferring means has a strip carrying surface and means for connecting a vacuum source to the surface to retain the strips thereon. Means are provided for stripping the strips from that surface for stacking. Grooves are preferably formed in the surface to receive elongated stripping fingers to divert the strips to a stacking position.

The stacking means includes magazine means having a strip or object entry opening disposed at the stacking position. Means are provided for pushing an object at the stacking position into the magazine entry opening. The pushing means includes a frame and means for pivotally supporting the frame for reciprocal motion forward to urge an object into the magazine opening and in reverse to retract the frame back behind the stacking position. Means responsive to the position of the transferring means actuates the pushing means when an object is in the stacking position.

In the preferred embodiment an elongated strip supply is withdrawn from roll stock and is cut into individual strips by a coacting knife drum and strip support drum combination. Feed rolls withdraw the elongated strip under the control of a registration scanner.

A vacuum drum is located in strip transfer position with the strip support drum and transfers the strips to a stacking means. The transfer drum has grooves formed in the strip transferring periphery thereof. Elongated finger means extend from the stacking means into the groove means for diverting strips from the periphery of the transfer drum to a stacking position at the stacking means.

The stacking means includes a magazine having an opening disposed adjacent the stacking position. Means are provided on the opposite side of the stacking position for pushing a strip at the position into the magazine opening. The elongated fingers advantageously extend from the pushing means.

A side wall of the magazine may be extended into the path of a strip diverted by the finger means to define the stacking position in front of the magazine opening. The bottom wall of the magazine may be similarly extended underneath the path of a strip diverted by the fingers for supporting a strip and/or defining the stack position in front of the magazine opening.

The magazine includes retaining latches adjacent the opening thereof for admitting strips to the magazine but preventing the strips from moving back out of the opening. The magazine further includes a strip back-up plate and means for yieldingly urging the plate toward the opening to enable the orderly building of a stack of strips in the magazine with the resulting back pressure of the stack against the retaining latches.

The strip pushing means includes a frame positioned across the stacking position from the magazine opening. The frame is pivotally supported for reciprocal motion toward and away from the magazine opening. The retaining latch means on the magazine are adapted to permit the pivoted pushing frame to swing in further on the side of the magazine opening furtherest from the pivot than on the side nearest the pivot while still restraining the strip in the magazine when the frame pivots away from the magazine.

Cam means responsive to the rotation of the transfer drum reciprocates the frame toward and away from the magazine opening, thereby establishing a timing relationship which reciprocates the frame after each strip is diverted to the stacking position. The side wall means extending into the path of a strip diverted into stacking position, to define a stacking position for strips, and the pivotal support means for the frame have an intermeshing slot/finger configuration to allow the frame to be pivoted up to the magazine opening without hitting the side wall extension. The frame is attached to a standard extending down in front of the magazine for connection to cam actuating means. A bottom wall extension of the magazine, for supporting a strip in stacking position, has a slot formed therein to accommodate the reciprocation of the frame and standard toward and away from the magazine opening.

As shown in the above-described embodiment, it is an object of this invention to provide improved apparatus for handling and stacking thin flexible objects or strips.

It is a further object of this invention to provide improved apparatus for stacking labels.

Other objects, advantages and features of this invention will become apparent when the following description is taken in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENT

Figure 1:
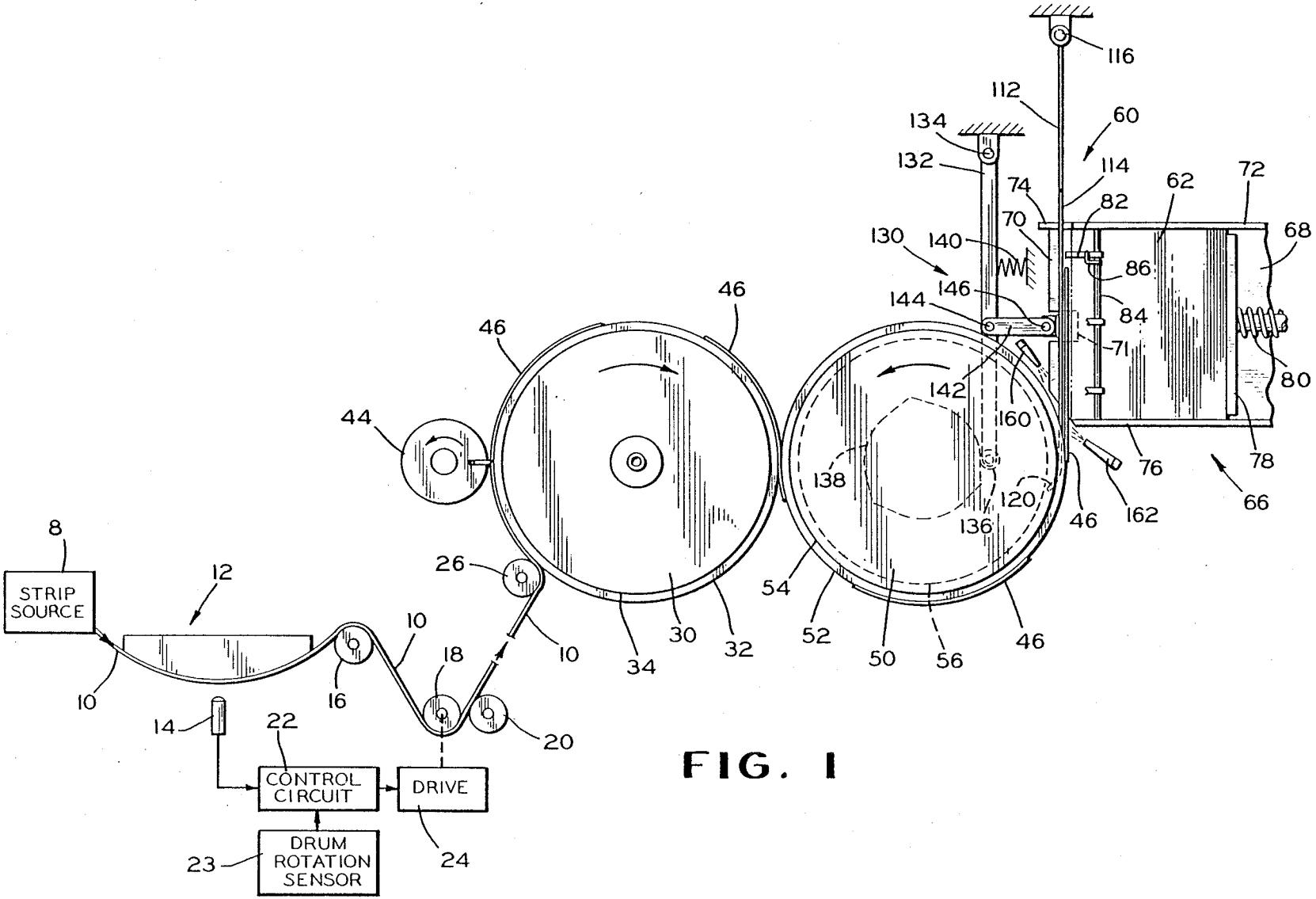
FIG. 1 is a plan view of apparatus embodying the teachings of this invention, with portions being represented schematically.
Figure 2:
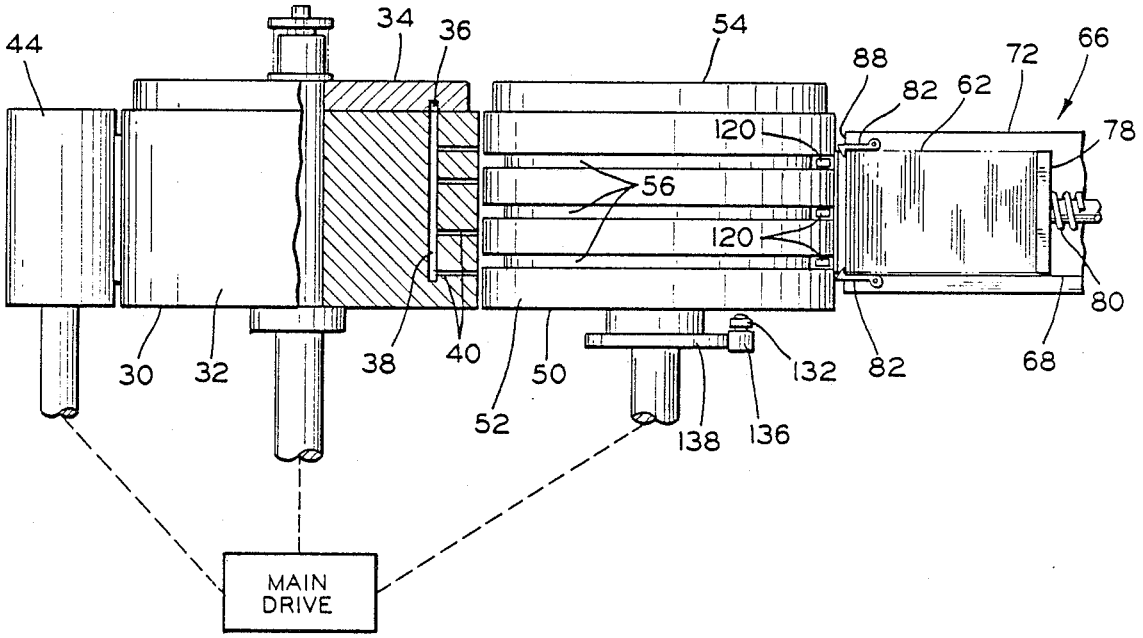
FIG. 2 is a front elevational view of the apparatus illustrated in FIG. 1, with some elements being omitted in this view for purposes of clarity.

Referring now to the drawings there is illustrated a preferred embodiment of the invention in which the thin flexible objects or strips to be handled or stacked are labels. The labels are formed by withdrawing a elongated continuous strip or web 10 from a source 8, which may be preprinted roll stock or a continuous web being printed or otherwise decorated by a printer. The apparatus is particularly useful with labels formed from thermoplastic materials, such as expanded oriented polystyrene or cellular polymeric material. Such labels have a tendency to cup or warp and are therefore more difficult to handle and stack.

The web 10 is drawn past a registration scanning station 12 and over an idler roller 16, which maintains the web 10 in a taut condition for scanning, by feed roll means including a driven roller 18 and an idler roller 20. A photoelectric scanning means 14 senses the end of a label and provides a signal to control circuit 22 which stops drive motor 24 from turning driven roller 18, and thus stops the feed of the web to the web cutting station.

The web cutting station includes coacting knife drum means 44 and strip support drum means 30, which are adapted to sever the web 10 into individual strips or labels 46. The strip support drum 30 continues to turn after a severing or cutting operation to space the severed individual labels 46 apart on the drum 30 and during the rest of the process. After the desired spacing between labels is achieved, the control circuit 22 receives a signal from a sensor 23 monitoring the rotation of drum 30 which energizes the drive 24 to rotate driven roller 18 to advance web 10 to pinch roller 26 where the web is pressed against drum 30 to help in retention of web 10 on drum 30.

Strip support drum 30 has means for connecting a vacuum source to the strip carrying surface or periphery 32 which includes a vacuum disc 34 on top of drum 30 which has a plenum 36 formed therein which communicates with vertical bores 38 and lateral bores 40 formed in drum 30. A similar vacuum connection is provided by vacuum disc 54 on transfer drum 50. This enables both drums to retain strips or labels 46 on the respective peripheries 32, 52. The vacuum source supplied to drum 50 may be stronger than that supplied to drum 30, so that a label 46 passing through the label transfer position between the two drums is transferred to and retained on drum 50. Alternatively, the vacuum to that portion of drum 30 which is in strip transfer position with respect to drum 50 may be disconnected by suitable valving techniques. All three drums 44, 30 and 50 are mounted on rotatable shafts turned by a main drive through appropriate gearing.

The strip transfer drum 50 has a plurality of grooves 56 formed in the strip carrying surface 52 thereof. The grooves 56 receive elongated stripping fingers 120 which divert the strip or label 46 to a stacking position in the stacking means indicated generally at 60 for accumulation in a stack of label 62.

The stacking means 60 includes a magazine 66 which is built in tray form in this embodiment, and includes a bottom wall 68 and side walls 72, 76 defining a front opening for receiving labels into the stack 62 in the tray. A back-up or pusher plate 78 is yieldingly urged toward the magazine opening by spring or other suitable means 80, so that the stack is yieldingly urged against the latch portions of retainer latch means 82 disposed adjacent the magazine opening. The latches 82 are pivotally mounted on rods 84 extending between side walls 72, 76 and are yieldingly urged into latching position by spring means 86. The latches 82 are thus pushed apart by the entry of a label or strip 46, but return to stack latching position after the label being put into the magazine passes the latching position of the label retainers 82.

Figure 3:
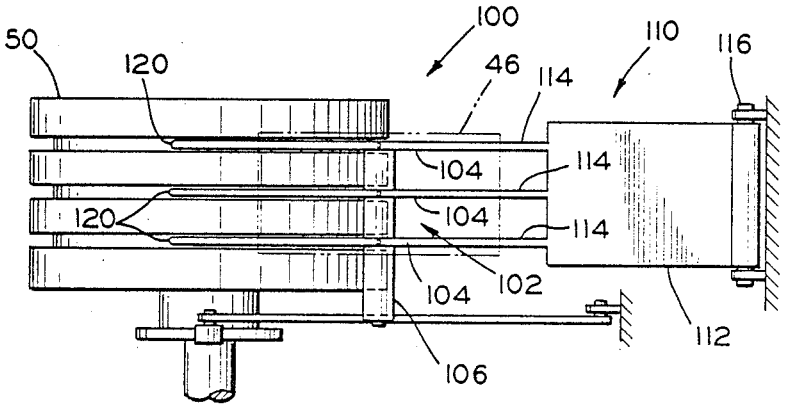
FIG. 3 is a side elevational view of the apparatus illustrated in FIG. 1, again with some elements being omitted in this view for the purposes of clarity.

A label pushing means 100 (best seen in FIG. 3) is provided on the opposite side of the stacking position, to which a label 46 is diverted by fingers 120, from the label entry opening of magazine 66. The pushing means includes a frame generally indicated at 102 which includes cross bars 104 secured in place by one or more vertical standards 106. A frame support is indicated generally at 110 and includes a support plate 112 having one side pivotally supported from the frame at 116 and having connecting members 114 extending from the other side to connect with frame 110.

The stripping fingers 120 are advantageously connected to and extend from 110. However, the stripping fingers may be independently supported in a fixed position and extend from between the cross bars 104 to perform the same function satisfactorily.

The label 46, when diverted from drum 50 by fingers 120, may be carried into the stacking position between the pushing means 100 and magazine 66 by inertia depending upon the weight, size and composition of the label. However, to insure exact registration in a stack position the apparatus may be designed to propel the label slightly past the magazine opening. Then, the side wall 72 may be provided with an extension 74 which extends into the path of a label 46 being stripped from drum 50 to stop the label 46 in registration with the magazine opening. The side wall extension 74 is configured so that the connectors 114 of the pivotal support structure 110 are intermeshed with finger elements of the side wall extension 74 in a slot/finger arrangement formed in the forward portion 88 of sidewall extension 74 to allow frame 100 to be pivoted up to the magazine opening without hitting the side wall extension 74.

Similarly, an extension 70 of the bottom wall 68 in front of the opening may act to define the bottom of the stacking position in front of the opening of magazine 66.

The bottom wall extension may also act to support the label in stacking position if there is any delay in arrival of the frame 102 to push the label into the magazine. A slot 71 in the bottom wall extension 70 accommodates the reciprocation of the frame standard 106.

While the use of the elongated stripping fingers 120 is adequate to divert the labels 46 from the vacuum retention of drum 50 in most applications, additional diverting means may be used. For example, air nozzle means 160 may be located as shown in FIG. 1 to assist in removing the label 46 from drum 50. Further, although the retention of the label 46 at the rear is normally enough to provide diverting momentum to label 46, air assist as by nozzle 162 may be used to propel or convey a label 46 into stacking position.

Since the pusher frame 102 is pivotally mounted it is not going to be parallel to the magazine opening at the end of its forward movement in the set-up illustrated in FIG. 1. Therefore, end walls 72, 74 are set back far enough behind the latching position of retainers 82 so that the frame 102 can get both ends or the entire length of the label into the magazine 66 behind the latching position of the retainers 82. As shown, side wall 76 has been set back further than side wall 72 since the arc of the pivotal swing is greater. However, it would also be possible to position magazine 66 so that the opening will be parallel to the frame 102 when it has completed its forward motion. The ends of side walls 72, 76 could then be positioned evenly.

Means for reciprocating the pushing frame 102 is generally indicated at 130. A connecting link 132 has one end pivotally connected to a frame portion at 134 and pivotally carries a cam follower 136 on the other end. The cam follower 136 is held against a cam surface of cam 138 by spring means 140. A second connecting link 142 is pivotally connected at one end 144 to the first connecting rod 132 and at the other end 146 to the bottom of the vertical standard 106 of the frame 102. The cam 138 is mounted on the same shaft as drum 50 and the cam surface is therefore responsive to the rotation of drum 50. The cam surface is configured so that the frame 102 is moved forward to push a label 46 into the magazine opening after the label arrives in the stacking position. The cam surface then permits the frame 102 to move in reverse back to its initial or starting position in time for the next label to move into the stacking position.

The form of the invention herein shown and described is to be taken as illustrative only, and changes in the shape, size and arrangement of the components, parts and portions may be made without departing from the spirit and scope of the invention.

I claim:

1. Apparatus for handling and stacking strips of material, comprising (a) means for successively supplying strips to be stacked, (b) means for stacking said strips, (c) vacuum drum means for transferring said strips from said supplying means to said stacking means, said drum means having groove means formed in the strip transferring periphery thereof for receiving strip diverting means, and (d) elongated finger means extending from said stacking means into said groove means for diverting strips from the periphery of said transfer drum means to a stacking position at said stacking means, (e) said stacking means including a magazine having an opening disposed adjacent said stacking position and means on the opposite side of said stacking position for pushing a strip at said position into said magazine opening, said elongated finger means extending from said pushing means.

2. Apparatus for handling and stacking strips as defined in claim 1 in which said magazine includes side wall and bottom wall means for maintaining stack alignment and defining said magazine opening, a side wall means extending into the path of a strip diverted by said finger means for defining a stacking position in registration in front of said magazine opening.

3. Apparatus for handling and stacking strips as defined in claim 2 in which said bottom wall means extends underneath the path of a strip diverted by said finger means to support a strip in stacking position in front of said magazine opening.

4. Apparatus for handling and stacking strips as defined in claim 1 in which said pushing means includes a frame positioned across the stacking position from said magazine opening and means for pivotally supporting said frame for pivotal motion toward and away from said magazine opening.

5. Apparatus for handling and stacking strips as defined in claim 4 in which said pushing means further includes means responsive to the rotation of said transfer drum means for pivoting said frame toward and away from said magazine opening.

6. Apparatus for handling and stacking strips as defined in claim 5 in which said drum means rotation responsive means includes a cam surface configured to pivot said frame after each strip is diverted to said stacking position.

7. Apparatus for handling and stacking strips as defined in claim 4 in which said magazine includes side wall means extending into the path of a strip diverted into stacking position for defining a stacking position for the strip, and in which said pivotal support means for said frame and said side wall means have an intermeshing slot/finger configuration to allow said frame to be pivoted up to the magazine opening without hitting said side wall extension.

8. Apparatus for handling and stacking strips as defined in claim 4 in which said magazine includes retaining means disposed adjacent the opening thereof for keeping the stack of strips therein, said retaining means being positioned to permit the pivoted pushing frame to swing in further on the side of said magazine opening furtherest from the pivot than on the side nearest the pivot while still restraining the strips in the magazine when the frame pivots away from the magazine.

9. Apparatus for handling and stacking strips, comprising (a) means for successively supplying strips to be stacked, (b) means for stacking said strips, (c) vacuum drum means for transferring said strips from said supplying means to said stacking means, said drum means having groove means formed in the strip transferring periphery thereof for receiving strip diverting means, and (d) elongated finger means extending from said stacking means into said groove means for diverting strips from the periphery of said transfer drum means to a stacking position at said stacking means, (e) said stacking means including a magazine having an opening disposed adjacent said stacking position and means on the opposite side of said stacking position for pushing a strip at said position into said magazine opening, (f) said pushing means including a frame positioned across the stacking position from said magazine opening and means for pivotally supporting said frame for reciprocal motion toward and away from said magazine opening, (g) said pushing frame being attached to a standard extending down in front of the magazine for connection to means responsive to rotation of said tranfer drum means for reciprocating said frame, said magazine having a bottom wall extending under the path of a strip diverted by said finger means to support a strip in front of the pushing means, said bottom wall having a slot formed therein to accommodate the reciprocation of the standard toward and away from the magazine opening.

* * * * *